United States Patent [19]

Braun

[11] Patent Number: 4,580,681

[45] Date of Patent: Apr. 8, 1986

[54] NESTABLE CASE

[76] Inventor: Bernard Braun, 834 Moore St., Woodmere, N.Y. 11598

[21] Appl. No.: 605,306

[22] Filed: Apr. 30, 1984

[51] Int. Cl.[4] ..... B65D 21/06

[52] U.S. Cl. ..... 206/506; 220/23.6; 220/7; 206/511

[58] Field of Search ..... 206/505, 506, 511; 220/23.6, 6, 7

[56] References Cited

U.S. PATENT DOCUMENTS

| | | | |
|---|---|---|---|
| 3,214,056 | 10/1965 | Box | 220/23.6 |
| 3,628,683 | 12/1971 | Friedrich | 220/6 |
| 3,700,137 | 10/1972 | Souza | 206/511 |
| 3,722,735 | 3/1973 | Herolzer | 206/506 |
| 4,170,313 | 10/1979 | Caves | 220/6 |
| 4,320,845 | 3/1982 | Waller | 220/7 |

FOREIGN PATENT DOCUMENTS

| | | | |
|---|---|---|---|
| 416441 | 1/1967 | Switzerland | 220/23.6 |
| 1261883 | 1/1972 | United Kingdom | 206/506 |

*Primary Examiner*—George E. Lowrance
*Attorney, Agent, or Firm*—Henry R. Lerner; Philip L. Rodman

[57] ABSTRACT

The nestable case is generally box-shaped with four side walls and a base. The side walls include upper fixed wall portions that are rigidly joined together to define a mouth portion of the case. The side walls also include moveable wall portions that are hinged to corresponding foldable sections of the base. When the case is fully loaded with containers the moveable wall portions and foldable sections of the base are in an expanded limit position. When the case is emptied the moveable wall portions and the foldable sections of the base can be moved to a contracted condition, which permits nesting of similarly empty cases. Fully loaded cases in the expanded limit position can be stacked one upon the other or arranged in a pinwheel configuration. A further embodiment of the invention includes provision of a shield at corner clearance openings to protect bruising of any portions of the containers that project from the corner clearance opening.

28 Claims, 11 Drawing Figures

Fig. 7.
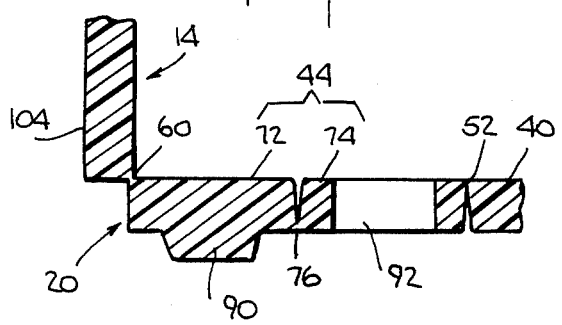
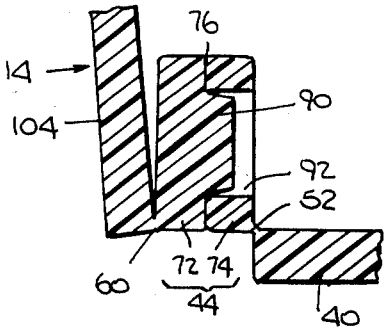
Fig. 8.
Fig. 9.
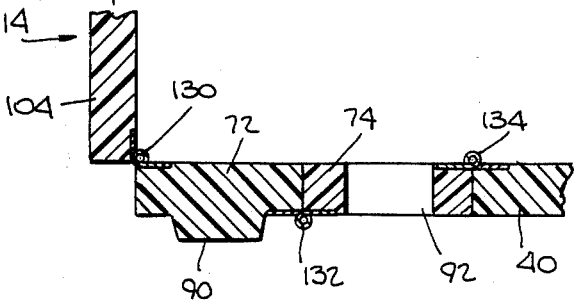
Fig. 10.
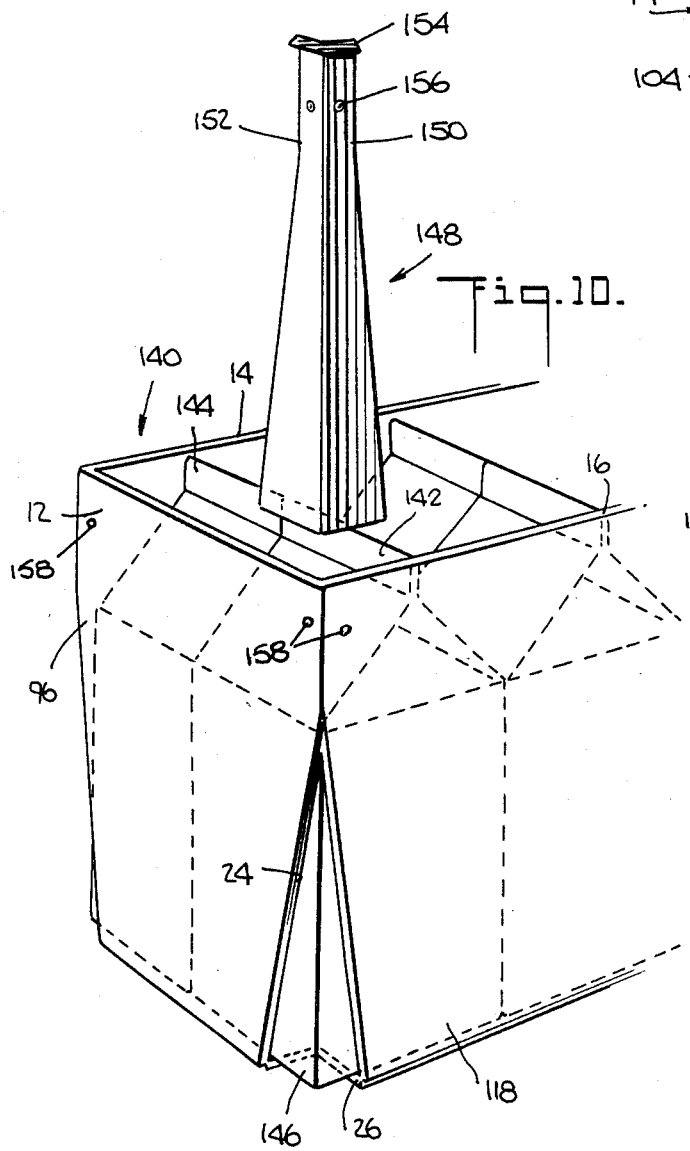
Fig. 11.
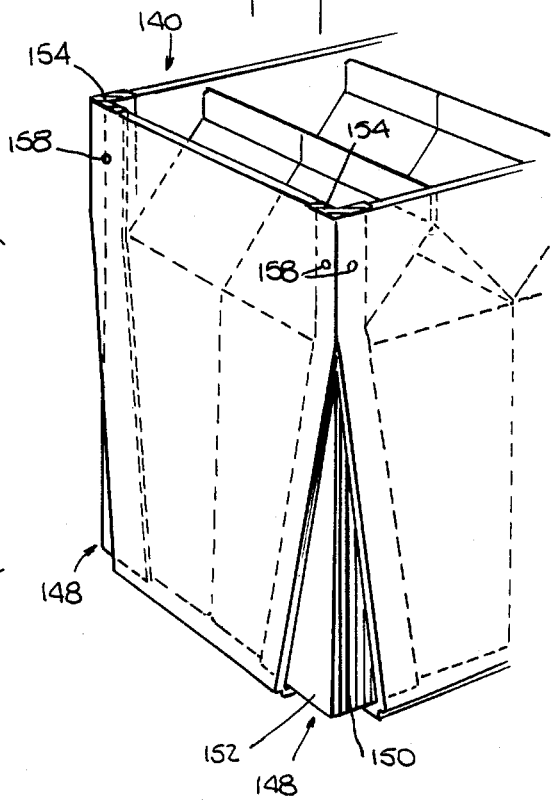

NESTABLE CASE

BACKGROUND OF THE INVENTION

This invention relates to cases for holding a plurality of containers, and more particularly to a case that can be stacked onto a second case of similar construction when both cases are filled to capacity, and nested inside the second case when both cases are empty.

Beverages, such as milk and soda, are generally sold at the retail level in individual containers of well-known size and shape. The beverage containers, which are often made of glass, plastic or paper constituents, are usually packed in predetermined quantities in cases for delivery from a bottler or container filling location to a distributor or retail outlet.

Since enormous quantities of such containers are transported from the filling location or distributor to the retailer, on a daily or weekly basis, it has long been a practice in the industry to provide reusable delivery cases. The reusable delivery cases are normally made of wood or plastic formed into a rigid, durable box-type structure.

One popular type of reusable delivery case made of plastic and known as a full-depth case, accommodates the entire height of containers packed therein and can be stacked onto other fully packed delivery cases. Generally the fully packed delivery cases are stacked on pallets in a predetermined fashion to facilitate loading and unloading of a transport vehicle. After the delivery cases are unloaded and unpacked they must be returned to the container filling location for reuse in packing newly filled containers.

Although empty delivery cases weigh substantially less than full cases, they occupy the same storage volume as a fully loaded delivery case. Consequently, the fuel costs for returning a cargo of empty delivery cases from a retailer back to a container filling location is essentially the same as the fuel costs for transporting the fully loaded cases from the container filling location to the retailer.

As fuel costs continue to increase, the burden of transporting empty cases at a cost that compares to that of delivering fully loaded cases becomes more and more objectionable. For a long time however, this problem has defied solution.

Oftentimes a cargo of loaded cases delivered to a retailer is not immediately unpacked. After the delivery cases are eventually unpacked they are temporarily stored at the retail facility for later pickup and return to the container filling location. Storage of empty delivery cases at a retail facility is a considerable problem since space is held at a premium. Consequently the empty delivery cases are often stored in an outside area so that the interior storage space can be used for incoming goods.

However, outdoor storage of empty delivery cases also presents further problems. Delivery cases left outdoors are often purloined to an extent that has aroused the concern of retailers and packers, who now expend additional money in theft prevention techniques and in financing organizations that attempt to recover stolen delivery cases.

It is thus desirable to provide a delivery case for containers which, when fully packed, can be stacked on other fully packed delivery cases but which takes up substantially less storage space when empty by being nestable in other similar empty delivery cases.

OBJECTS AND SUMMARY OF THE INVENTION

Among the several objects of the present invention may be noted the provision of a novel case for holding a plurality of containers, a novel case that can be stacked on a second case when both cases are fully loaded and can be nested inside the second case when both cases are empty, a novel case that has an expanded limit condition to accommodate a full load and a contracted condition which permits nesting of empty cases, a novel case with deflectable side walls and a contractable base, and a novel case with novel interlocking projections that permit stacking of cases in a pinwheel configuration.

Other objects and features will be in part apparent and in part pointed out hereinafter.

The present invention relates to a novel case that has an expanded limit position for holding a full load of containers and a contracted condition, when empty, that permits nesting of empty cases.

In one embodiment of the invention the nestable case has an expanded limit position wherein the case is in the general shape of a box with four side walls and a base portion. Each of the wall members has a moveable wall portion joined to the base by a hinging arrangement.

The base includes a median section and foldable sections that extend from the median section to the respective moveable wall portions, and are joined to the moveable wall portions by the hinging arrangement. A clearance space provided between neighboring wall portions that continues into the base permits pivotal movement of the moveable wall portions from an expanded limit position to a contracted position. The case will accommodate a full load of containers when it is in its expanded limit position.

The wall portions of the case, collectively at their free ends, define a mouth of fixed size for the case. The base, however, has an expanded size which bridges the mouth of another similar case when the moveable wall portions are in their expanded limit position. Conversely, when the moveable wall portions are in their contracted position the base contracts to a contracted base size that is less than the fixed size of the mouth of another similar case to permit the base of one case to fit in the mouth of another case.

When the case is empty and in its contracted position, the moveable walls are inclined to the base and the base is likewise contracted. Consequently each empty case can be nested to form a stack of empty cases. In a stack of nested empty cases, the spacing between consecutive base portions is substantially less than the overall wall height from the base to the mouth of the case.

To facilitate stacking of fully loaded cases, protrusions are provided on an outside surface of the base in predetermined positions. The stacking position of one fully loaded case on another fully loaded case is thus predetermined by engagement of the protrusions of one case in the mouth of the next lower case in a stack. The protrusions can be provided at respective predetermined spacings on the outside surface of the base to permit stacking of fully loaded cases in a predetermined pinwheel configuration.

Recesses or openings can also be provided in the base, to accommodate the protrusions, when the case is in its contracted position. The openings thus provide clearance for the protrusions to permit maximum contracting of the case.

If desired, the openings can be sized to provide a detent engagement with the protrusions to maintain the empty case in its contracted position until the moveable walls are urged by a full load of containers into the expanded limit position.

In a further embodiment of the invention, a moveable corner flap section is provided next to neighboring pairs of moveable wall portions. The flap section thus provides corner protection in the clearance spaces between the neighboring wall portions.

The invention accordingly comprises the constructions hereinafter described, the scope of the invention being indicated in the following claims.

DESCRIPTION OF THE DRAWINGS

In the accompanying drawings, in which various possible embodiments of the invention are illustrated.

FIG. 7 is an enlarged fragmentary sectional view of the expanded limit position of the case;

FIG. 8 is an enlarged fragmentary sectional view of the contracted condition of the case;

FIG. 9 is a view similar to FIG. 7 showing another embodiment of the invention;

FIG. 10 is a partially exploded fragmentary perspective view of another embodiment of the invention; and, FIG. 11 is the embodiment of FIG. 10 in assembled condition.

Corresponding reference characters indicate corresponding parts throughout the several views of the drawings.

DETAILED DESCRIPTION OF THE INVENTION

Figure 1:
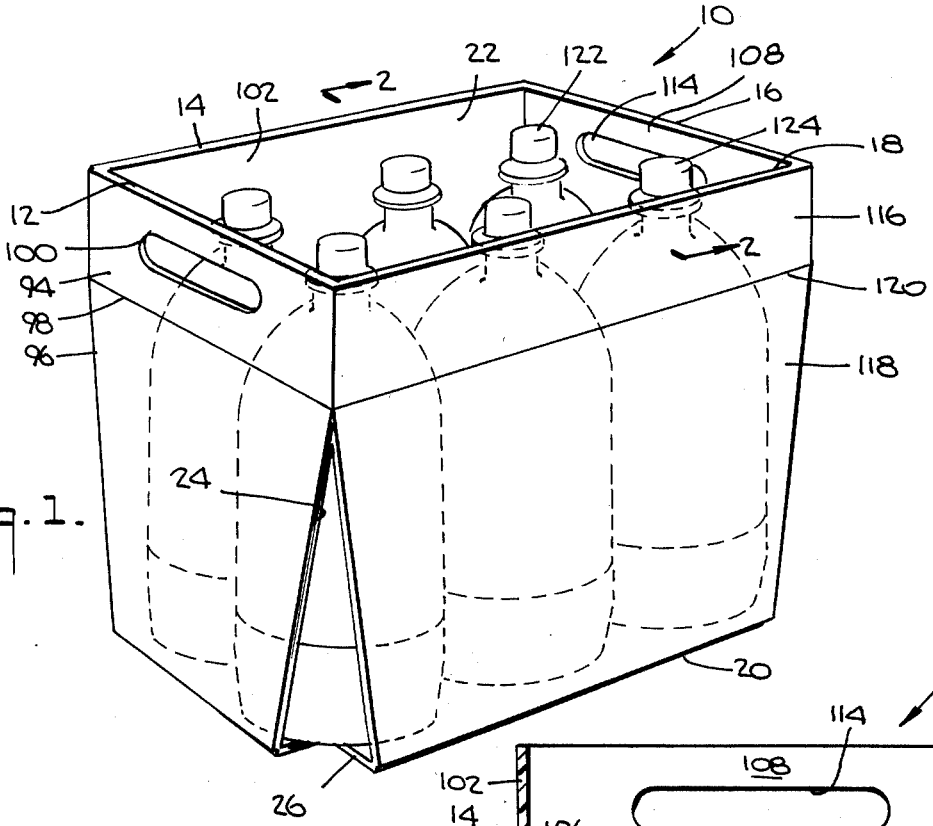
FIG. 1 is a perspective view of a case incorporating one embodiment of the invention.

Referring now to the drawings, a case incorporating the present invention is generally indicated by the reference number 10 in FIG. 1.

The case 10, which is preferably formed of polyethylene, is generally box-shaped and includes four side walls 12, 14, 16 and 18 joined by a base 20. A mouth 22 of the case 10 is defined by the collective free ends of the walls 12, 14, 16 and 18.

A wall clearance opening 24 is provided at the corner junction of the neighboring walls 12 and 18 of the case 10. The wall clearance opening 24 starts at a predetermined distance from the mouth 22 of the case and diverges as it extends toward the base 20. A base clearance opening 26 is provided at a corner of the base 20 corresponding to the corner junction of the neighboring walls 12 and 18. The wall clearance opening 24 thus continues into the base clearance opening 26.

Additional wall clearance openings 28, 30 and 32 (FIG. 5) corresponding to the wall clearance opening 24 are respectively provided at the corner junctions of the neighboring walls 12, 14; 14, 16; and 16, 18. Also, additional base clearance openings 34, 36 and 38 (FIG. 5) corresponding to the base clearance opening 26 are respectively continuous with the wall clearance openings 28, 30 and 32.

Figure 5:
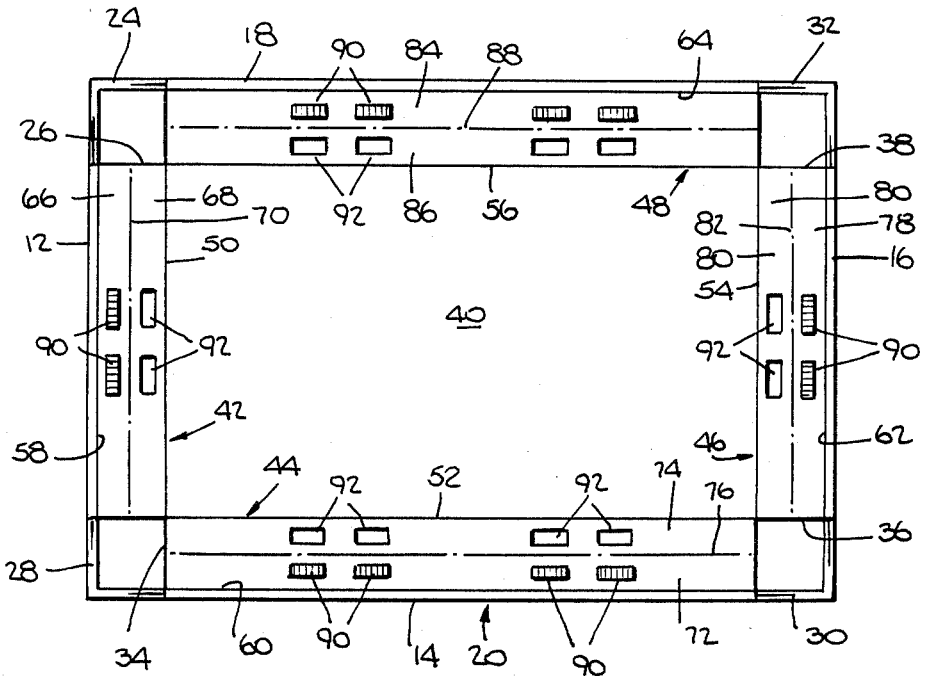
FIG. 5 is a bottom view of the case in its expanded limit position.

Referring to FIG. 5, the base 20 includes a median section 40 and foldable sections 42, 44, 46 and 48 that respectively extend from the median section 40 to the side walls 12, 14, 16 and 18. The foldable section 42 is hinged to the median section 40 at hinge 50. Similarly the foldable sections 44, 46 and 48 are hinged to the median section 40 by the respective hinges 52, 54 and 56.

Unless otherwise stated, the term hinge refers to a molded hinge structure of the type known as a living hinge. The foldable section 42 is likewise hinged to the wall portion 12 at a hinge 58. Similarly the foldable sections 44, 46 and 48 are hinged to the respective side walls 14, 16 and 18 by the hinges 60, 62 and 64.

Each foldable section 42, 44, 46 and 48 includes two foldable segments hinged to each other. Thus the foldable section 42 includes foldable segments 66 and 68 hinged at 70. The foldable section 44 includes foldable segments 72 and 74 hinged at 76. Also the foldable section 46 includes foldable segments 78 and 80 hinged at 82. And the foldable section 48 includes foldable segments 84 and 86 hinged at 88.

A plurality of protrusions 90 having a predetermined spacing are formed on the foldable segments 66, 72, 78 and 84, whereas a corresponding plurality of openings 92 are formed in the foldable segments 68, 74, 80 and 86 to accommodate the protrusions 90. The openings 92 can be sized to provide full clearance for the protrusions 90 or can be sized to provide a slight detent engagement with the protrusions 90.

Referring to FIG. 1 the side wall 12 includes a fixed wall portion 94 and a moveable wall portion 96 moveable about a fold axis 98 and hinged to the base at the hinge 58 (FIG. 5). A handle opening 100 is provided in the fixed wall portion 94. Similarly the side wall 14 includes a fixed wall portion 102 and a moveable wall portion 104 (FIG. 4) moveable about a fold axis 106 and hinged to the base 40 at the hinge 60 (FIG. 5).

Figure 2:
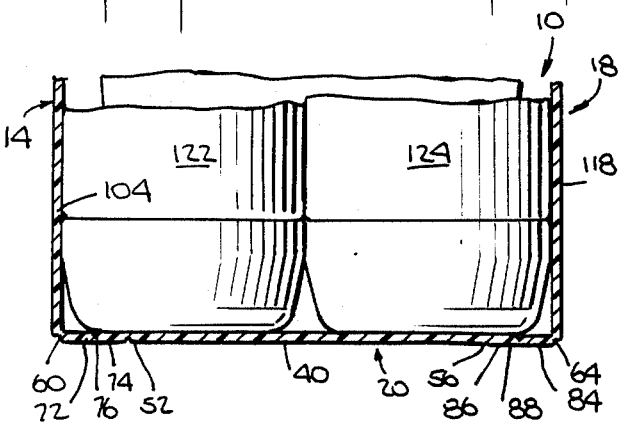
FIG. 2 is a sectional view, taken on the line 2—2 of FIG. 1, showing the expanded limit position of the case, when fully loaded.

Referring to FIGS. 1, 2 and 5 the side wall 16 likewise includes a fixed wall portion 108 and a moveable wall portion 110 moveable about a fold axis 112 and hinged to the base 40 at the hinge 62. A handle opening 114 is provided in th fixed wall portion 108. Also the side wall 18 includes a fixed wall portion 116 and a moveable wall portion 118 moveable about a fold axis 120 and hinged to the base 40 at the hinge 64.

In using the case 10, a plurality of containers such as two-liter soda bottles 122 and 124 are arranged side by side in the case 10 as shown in FIG. 1. Since the case 10 is sized to accommodate the full height of the soda bottles 122, 124 it is known as a full depth case.

The case 10 is of a predetermined size such that it becomes fully loaded when a predetermined number of containers are disposed therein. For example, the case 10 is fully loaded when six two-liter soda bottles are disposed therein. When the case is fully loaded it is in its expanded limit position, which is characterized by the foldable sections 42, 44, 46 and 48 of the base 20 being substantially coplanar with the median section 40 as shown in FIGS. 2 and 5. The expanded limit position of the case 10 is further characterized by the moveable wall portions 96, 104, 110 and 118 being at a first predetermined angle with respect to the base 20, which angle is approximately 90 degrees such as shown in FIG. 2.

It will be most apparent from FIG. 2 that the case 10 is sized such that the side-by-side arrangement of the containers 122 and 124 urges the moveable wall portions 104 and 118 into their expanded limit position. Similarly, when three of the bottles are in side-by-side arrangement as shown in FIG. 1, they urge the moveable wall portions 96 and 110 into their expanded limit position, and simultaneously the foldable sections 42, 44, 46 and 48 of the base 20 are disposed in their expanded limit positions.

As shown in FIG. 5 the protrusions 90 are located on the foldable sections 42, 44, 46 and 48 such that they are received inside the mouth 22 of a lower case similar to case 10 in a stack of fully loaded cases. The protrusions 90 by depending into the mouth 22 of a lower case in a stack, help to locate the stacking positions of fully loaded cases and also prevent dislodging of the cases once they are stacked.

With the case 10 in its fully loaded condition the moveable wall portions 96, 104, 110 and 118 are substantially coplanar with the fixed wall portions 94, 102, 108 and 116 such that all wall portions are substantially perpendicular to the base 20. Consequently, when one fully loaded case is stacked on another fully loaded case, with both cases being in similar orientation, the weight of the upper fully loaded case is borne by the walls of the lower fully loaded case.

Figure 6:
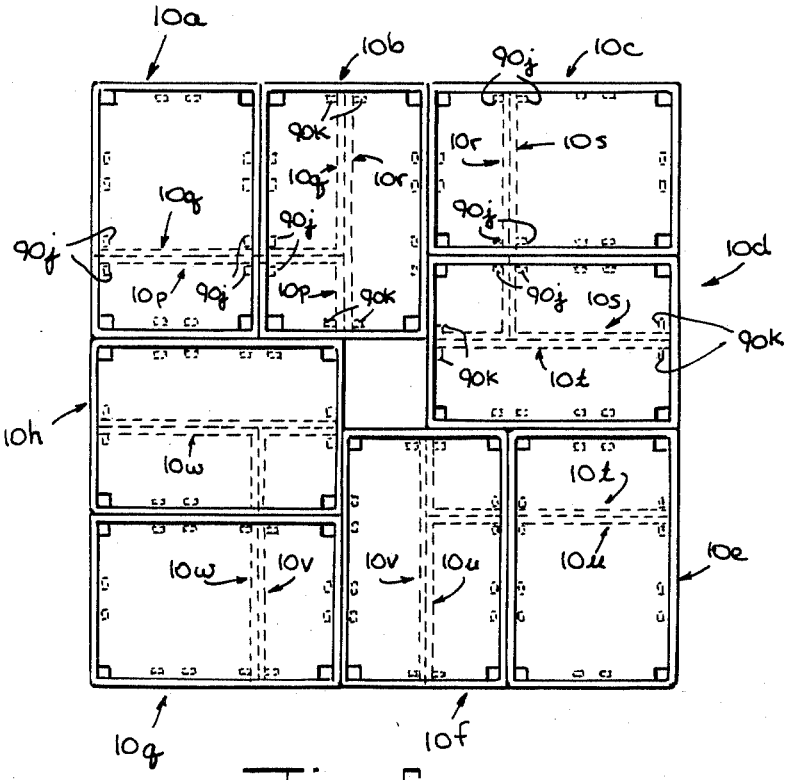
FIG. 6 is a top view of a plurality of cases stacked in a pinwheel configuration.

If desired, fully loaded cases can be stacked on a pallet to facilitate loading and unloading of a cargo of cases. It has been found that certain stacking arrangements of cases are more stable than others, especially a stacking arrangement known as the pinwheel configuration as illustrated in FIG. 6. The pinwheel configuration is especially suited for loading cases that have two relatively short sides and two relatively long sides. Accordingly, a pair of similarly oriented cases is placed adjacent a pair of cases that is oriented 90 degrees relative to the orientation of the first pair of cases and so on to form a closed pinwheel pattern.

The next layer of cases is loaded in similar fashion except that the pinwheel pattern is rotated approximately 90 degrees relative to the first pinwheel pattern such as shown in dotted outline in FIG. 6. The protrusions 90 are arranged on the respective bases 20 of all cases in a manner that insures engagement of the free ends of the wall portions of a lower case intermediate preselected protrusions in the base of an upper case.

For example, referring again to FIG. 6, the top cases in the pinwheel stacking arrangement are shown in solid line and the lower cases in said stack are shown in dotted outline. An upper case 10*a* has protrusions 90*j* and sits upon two lower cases 10*q* and 10*p*. Wall portions of the lower case 10*q* and the lower case 10*p* are disposed between the protrusions 90*j* of the base of the upper case 10*a*. Another upper case 10*b* sits upon the lower case 10*q*, the lower case 10*p* and a lower case 10*r*. Wall portions of the lower case 10*q* and 10*p* are disposed between projections 90*j* of the upper case 10*b*. In addition, wall portions of the lower case 10*q*, the lower case 10*p* and the lower case 10*r* are disposed between the projections 90*k* on the base of the upper case 10*b*. An upper case 10*c* is stacked upon portions of the lower case 10*r* and 10*s*. Wall portions of the lower case 10*r* and the lower case 10*s* are disposed between the projections 90*j* formed at the base of the upper case 10*c* in the same fashion as the upper case 10*a* was stacked on the lower cases 10*p* and 10*q*.

In addition, an upper case 10*d* is supported on portions of the lower case 10*r*, the lower case 10*s* and a lower case 10*t*. Thus, wall portions of the case 10*r* and the case 10*s* are disposed between projections 90*j* of the upper case 10*d*. In addition, wall portions of the lower case 10*r*, 10*s* and 10*t* are disposed between the projections 90*k* on the base of the upper case 10*d* in the same fashion as the upper case 10*b* is supported on portions of the lower cases 10*p*, 10*q* and 10*r*.

The support arrangement for the upper cases 10*e*, 10*f*, 10*g* and 10*h* is similar to that described for the cases 10*a*, 10*b*, 10*c* and 10*d*. Thus, the predetermined arrangement and spacing of the projections 90 on the cases 10 insure a stable and secure stacking arrangement of such cases in a pinwheel configuration.

Figure 3:
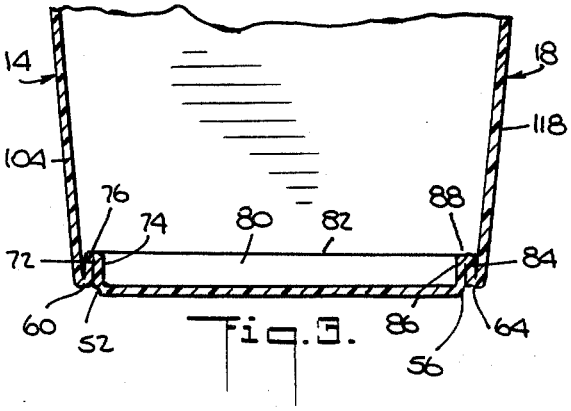
FIG. 3 is a sectional view similar to FIG. 2, but showing the contracted condition of the case when empty.

Once a case 10 is emptied by removing the containers, the moveable wall portions such as 104 and 118 of FIG. 3 will normally move to a contracted position about the fold axes 106 and 120 (FIG. 4) especially if the cases are originally molded in a contracted position. A similar contracting movement of the moveable walls 96 and 110 will also occur with respect to the fold axes 98 and 112 (FIGS. 1 and 4).

A typical contraction of the base 20 is shown in FIGS. 7 and 8. Thus when a moveable wall portion 104 as shown in FIG. 7 is moved to its contracted limit position the foldable segments 72 and 74 converge toward each other about the hinge 76. Moreover, the moveable wall portion 104 converges toward the foldable segment 72 about the hinge 60. Consequently, when the case is in its contracted limit position the protrusion 90 is accommodated in the opening 92 to assure maximum contraction. If desired, the opening 92 can be sized to provide a slight detenting engagement with the protrusion 90 to maintain the case 10 in its contracted limit position when empty.

Figure 4:
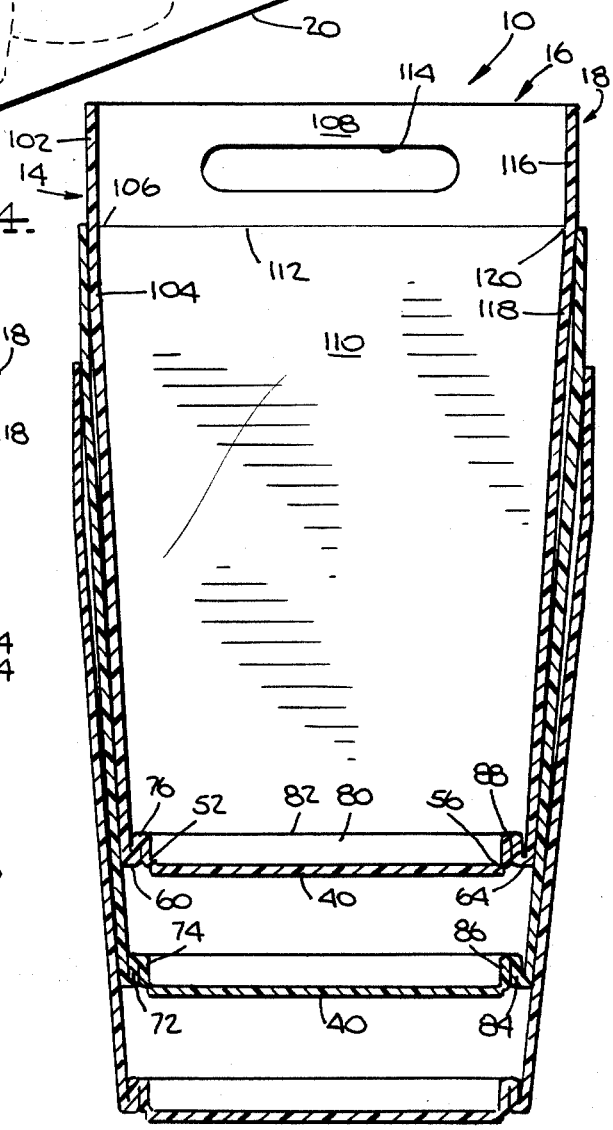
FIG. 4 is a sectional view of a stack of nested empty cases.

As most clearly shown in FIG. 4 the case 10 when empty is receivable in the mouth 122 of another similarly empty case to provide a nestable stacking arrangement. It will be noted that the fixed wall portions 94, 102, 108 and 116 are rigidly joined to each other and do not pivot or deflect when the associated moveable wall portions move from their expanded limit position to their contracted positions. Thus the nesting depth of one case with respect to another case is determined by the engagement of the fixed wall portions of an upper case with the mouth 122 of a lower case in the nested stacking arrangement as shown in FIG. 4.

In another embodiment of the invention as shown in FIG. 9, the previously described living hinges are replaced by separate hinges such as shown at 130, 132 and 134.

In a still further embodiment of the invention as shown in FIGS. 10 and 11, a case 140 identical to the case 10 is fully loaded with milk containers such as 142 and 144 of a well known conventional structure. The milk container 142 includes a corner portion 146 projecting from the wall clearance opening 24 and the base clearance opening 26. Other milk containers in the remaining three corner locations of the cas 140 include similarly projecting corner portions.

Since the milk container is made of a paperboard construction it might be subject to damage at the area where the corner portion 146 projects from the clearance openings 24 and 26. Thus a flap portion 148 formed of a suitable gauge plastic includes two sections 150 and 152 at right angles to each other with an end fold 154. The flap portion 148 is secured to the interior surface of the walls 12 and 16 for example, by engagement of the end fold 154 with the corner junction, as shown in FIG. 11.

Securement of the flap portion 148 to the walls 12 and 16 can also be accomplished by engagement of projections 156 on the flap portion 148 with corresponding holes 158 provided in the walls of the case 10 as shown in FIGS. 10 and 11. The flap portion 148 can thus move with the corresponding moveable wall portions 96 and 118 when such moveable wall portions undergo movement from their expanded limit position to the contracted limit position. If desired, a clearance notch (not shown) can be provided in the sections 150 and 152 to avoid interference with the foldable sections 42, 44, 46 and 48 of the base 20.

Under this arrangement the flap portion 148 protects the projecting corner portion 146 of the milk container from any bruising that might occur when one fully loaded case 140 is bumped against another similarly fully loaded case.

As will be apparent to those skilled in the art the case 10 can be made in any selected size depending upon the type of container and quantity of containers being packed. The arrangement and spacing of the protrusions 90 can be developed to permit known stacking arrangements other than the pin-wheel configuration. Such arrangement and spacing of the protrusions 90 would depend upon the size of the pallet and the size of the cases being used.

In view of the above it will be seen that the several objects of the invention have been acheived and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A nestable case comprising, (a) a plurality of movable wall portions in neighboring arrangement, (b) a base adjoining said movable wall portions, (c) hinge means on said base and said movable wall portions providing a hinge between said base and said movable wall portions, (d) pivot means on said movable wall portions spaced from said hinge means, said pivot means and said hinge means permitting movement of said movable wall portions relative to said base from an expanded limit position, wherein said movable wall portions are at a first predetermined angle relative to said base, to a contracted position wherein said movable wall portions are inclined relative to said base at an angle greater than said first predetermined angle, (e) each of said movable wall portions having opposite side edges which taper toward each other in a direction from said pivot means to said hinge means to provide clearance with respect to the side edges of a neighboring movable wall portion when said movable wall portions are in said contracted position, (f) wherein neighboring pairs of said movable wall portions have neighboring side edges that diverge away from each other in a direction from said pivot means to said base to form an opening for said clearance between said neighboring side edges, and (g) a flap section supported next to each said neighboring pair of movable wall portions for movement with respective said neighboring pairs of movable wall portions when said respective neighboring pairs of movable wall portions move from said expanded limit position to said contracted position, said flap sections depending to said base and having border edges which respectively correspond to and extend beyond the neighboring side edges of each said neighboring movable wall portions to cover said opening.

2. The nestable case as claimed in claim 1, wherein a fixed wall portion extends from the pivot means of each of said moveable wall portions and said neighboring fixed wall portions are rigidly joined to each other, and each said respective flap is secured to at least one of two corresponding respective neighboring fixed wall portions.

3. The nestable case as claimed in claim 1, wherein said base comprises a median section and a foldable section extending from said median section to each said moveable wall portion.

4. The nestable case as claimed in claim 3, wherein said hinge means include a first hinge adjoining said median section and said foldable section, and a second hinge adjoining said foldable section and each of said moveable wall portions.

5. The nestable case as claimed in claim 4, wherein said foldable section includes two foldable segments hinged to each other by a third hinge, one of said segments being hinged to said median section by said first hinge and the other of said foldable segments being hinged to each of said moveable wall portions by said second hinge.

6. The nestable case as claimed in claim 5, wherein one of said first, second and third hinges is a living hinge.

7. The nestable case as claimed in claim 5, wherein said first, second and third hinges are living hinges.

8. The nestable case as claimed in claim 4, wherein said first, second and third hinges are positioned such that said foldable segments converge toward each other and said third hinge moves in a direction toward said pivot means when said moveable wall portions move from said expanded limit position to said contracted position.

9. A nestable case comprising, (a) a movable wall portion, (b) a base adjoining said movable wall portion, including a median section and a foldable section extending from said median section to said movable wall portion, (c) hinge means on said base and said movable wall portion providing a hinge between said base and said movable wall portion, said hinge means including a first hinge adjoining said median section and said foldable section, and a second hinge adjoining said foldable section and said movable wall portion, said foldable section including two foldable segments hinged to each other by a third hinge, one of said segments being hinged to said median section by said first hinge and the other of said foldable segments being hinged to said movable wall portion by said second hinge, (d) pivot means on said movable wall portion spaced from said hinge means, said pivot means and said hinge means permitting movement of said movable wall portion relative to said base from an expanded limit position, wherein said movable wall portion is at a first predetermined angle relative to said base, to a contracted position wherein said movable wall portion is inclined relative to said base at an angle greater than said first predetermined angle, (e) said first, second and third hinges being positioned such than said foldable segments converge toward each other and said third hinge moves in a direction toward said pivot means when said movable wall portion moves from said expanded limit position to said contracted position, and (f) at least one protrusion is provided on one of said foldable segments and a corresponding opening is provided in the other of said foldable segments such that said protrusion is engageable in said opening when said foldable segments are converged against each other.

10. The nestable case as claimed in claim 9, including a plurality of said moveable wall portions in neighboring arrangement to form an encasing structure having an open end opposite said base, and a corresponding plurality of said foldable sections interconnecting said moveable wall portions and the median section of said base, at least one protrusion being provided on each of said foldable sections in respective predetermined positions such that one said nestable case can be stacked onto and supported by another said nestable case when the moveable wall portions of the stacked cases are in the expanded limit position, the stacking position of said one nestable case on the other said nestable case being predetermined by engagement of the protrusions on the stacked case in the open end of the support case.

11. The nestable case as claimed in claim 10, wherein a plurality of said protrusions are provided on each of said foldable sections at respective predetermined spacing such that the stacked and support cases can be arranged in a predetermined pinwheel configuration.

12. A nestable case comprising, (a) a base, (b) a plurality of wall members, each having a movable wall portion joined to said base in neighboring arrangement to form an encasing structure, (c) hinge means on said base and each of said movable wall portions for providing a hinge between said base and said movable wall portions, (d) said wall members each having a fixed wall portion and pivot means on each of said movable wall members for pivotally joining the respective movable wall portions to the respective fixed wall portions, (e) a clearance space provided between neighboring wall portions and in said base between said neighboring wall portions to permit pivotal movement of said movable wall portions about said pivot means from an expanded limit position wherein said movable wall portions are at a first predetermined angle relative to said base, to a contracted position wherein said movable wall portions are inclined to said base at an angle greater than first predetermined angle, (f) said encasing structure being generally rectangular with oppositely disposed movable wall portions when said movable wall portions are in said expanded limit position and, (g) the neighboring fixed wall portions of each said wall member being rigidly joined to each other and form a mouth of fixed size for said case, said base being of expanded base size to bridge the mouth of another similar case when said movable wall portions are in said expanded limit position, and a flap section supported next to each said neighboring pair of movable wall portions for movement with respective said neighboring pairs of movable wall portions when said respective neighboring pairs of movable wall portions move from said expanded limit position to said contracted position, said flap sections depending to said base and being sized to cover said clearance space.

13. The nestable case as claimed in claim 12 wherein each said respective flap is secured to at least one of two corresponding respective neighboring fixed wall portions.

14. The nestable case as claimed in claim 12, wherein said base comprises a median section and a plurality of foldable sections corresponding to said moveable wall portions, and extending from said median section to respective said moveable wall portions, said hinge means including respective first hinges joining said median section and respective foldable sections, and respective second hinges joining said respective foldable sections and said respective moveable wall portions such that said base contracts to a contracted base size less than the fixed size of said case mouth and said oppositely disposed moveable wall portions converge toward each other when said moveable wall portions are in said contracted position to permit nestable stacking of one of the cases into the mouth and toward the base of another said case.

15. A case for holding a plurality of containers comprising (a) a base having an extended position with a first predetermined outer periphery, and a contracted position with a second predetermined outer periphery smaller than said first predetermined outer periphery, (b) a plurality of side walls joined to said base in neighboring arrangement to form an encasing structure having an open end opposite said base, (c) each of said side walls having a movable wall portion for movement from an expanded condition wherein said movable wall portions are in a first limit position and said base is in said extended position, to a contracted condition wherein said movable wall portions are in a second limit position and said base is in said contracted position whereby the base has a contracted size smaller than the open end of said case, such that said case is nestable in another similar case when the respective movable wall portions of said case are in said contracted condition, and said case can be filled to capacity with said containers when said movable wall portions are in said expanded condition, (d) said movable wall portions having opposite side edges which taper toward each other in a direction from said open end to said base to provide a clearance opening between the side edges of neighboring movable wall portions, and (e) a flap section supported next to each said neighboring pair of movable wall portions for movement with respective said neighboring pairs of movable wall portions when said respective neighboring pairs of movable wall portions move from said expanded limit position to said contracted position, said flap sections depending to said base and having border edges which respectively correspond to and extend beyond the neighboring side edges of each said neighboring movable wall portion to cover said openings.

16. The case as claimed in claim 15, having four side walls, including first and second opposing pairs of said side walls, the moveable wall portions of said first and second opposing pairs of side walls being maximally diverged when said moveable wall portions are in said first limit position and said moveable wall portions of said first and second opposing pairs of side walls being maximally converged toward each other when said moveable wall portions are in said second limit position.

17. The case as claimed in claim 15, including cooperating means on said side walls and said base to enable said moveable wall portions to selectively assume said first and second limit positions.

18. The case as claimed in claim 17, wherein said cooperating means include hinging means for moveably joining said moveable wall portions to said base and respective said side walls.

19. The case as claimed in claim 15, wherein each of said side walls includes a fixed wall portion, said fixed wall portions being rigidly joined to each other to define the open end of said case.

20. The case as claimed in claim 15, wherein said base comprises a median section and a foldable section extending from said median section to each of said moveable wall portions.

21. The case as claimed in claim 20, wherein a respective first hinge joins said median section and each respective said foldable section, and a respective second hinge joins each respective said foldable section and each respective said moveable wall portion.

22. The case as claimed in claim 21, wherein each respective said foldable section includes two foldable segments hinged to each other by a respective third hinge, one of said segments being hinged to said median section by a respective said first hinge and the other of said foldable segments being hinged to a respective said moveable wall portion by a respective said second hinge.

23. The case as claimed in claim 22, wherein one of said first, second and third hinges is a living hinge.

24. The case as claimed in claim 23, wherein said first, second and third hinges are living hinges.

25. The case as claimed in claim 21, wherein the respective said first, second and third hinges are positioned such that the respective said foldable segments converge toward each other and the respective said third hinges move in a direction toward said open end when the respective said moveable wall portions move from said expanded condition to said contracted condition.

26. The case as claimed in claim 25, wherein at least one protrusion is provided on each respective one of said foldable segments and a corresponding opening is provided in each respective one of the other said foldable segments such that respective said protrusions are engageable in respective said openings when respective said foldable segments are folded against each other.

27. The case as claimed in claim 26, wherein respective said protrusions are provided on each of the respective said foldable sections in respective predetermined positions such that one said case can be stacked onto and supported by another said case when the respective moveable wall portions of the stacked cases are in the expanded condition, the stacking position of said one case on the other said case being predetermined by engagement of the respective protrusions on the stacked case in the open end of the support case.

28. The case as claimed in claim 27, wherein a plurality of said protrusions are provided on each respective one of said foldable sections at respective predetermined spacing such that the stacked and support cases can be arranged in a predetermined pinwheel configuration.

* * * * *